US006738452B2

(12) United States Patent
McGregor et al.

(10) Patent No.: US 6,738,452 B2
(45) Date of Patent: May 18, 2004

(54) GASDYNAMICALLY-CONTROLLED DROPLETS AS THE TARGET IN A LASER-PLASMA EXTREME ULTRAVIOLET LIGHT SOURCE

(75) Inventors: Roy D. McGregor, El Camino Village, CA (US); Robert A. Bunnell, Redondo Beach, CA (US); Michael B. Petach, Redondo Beach, CA (US); Rocco A. Orsini, Long Beach, CA (US)

(73) Assignee: Northrop Grumman Corporation, Redondo Beach, CA (US)

( * ) Notice: Subject to any disclaimer, the term of this patent is extended or adjusted under 35 U.S.C. 154(b) by 38 days.

(21) Appl. No.: 10/156,879

(22) Filed: May 28, 2002

(65) Prior Publication Data

US 2003/0223546 A1 Dec. 4, 2003

(51) Int. Cl.[7] ..... G21G 4/00
(52) U.S. Cl. ..... 378/119; 378/143
(58) Field of Search ..... 378/119, 143, 378/122; 250/493.1, 504 R

(56) References Cited

U.S. PATENT DOCUMENTS

| | | | | |
|---|---|---|---|---|
| 4,723,262 A | 2/1988 | Noda et al. | ..... | 378/119 |
| 5,577,092 A | 11/1996 | Kublak et al. | ..... | 378/119 |
| 6,002,744 A | 12/1999 | Hertz et al. | ..... | 378/119 |

OTHER PUBLICATIONS

Rymell, L., Berglund, M., Hansson, B.A.M. & Hertz, H.M., "X–ray and EUV laser–plasma sources based on cryogenic liquid–jet target", SPIE vol. 3676, Mar. 1999, pp. 424–424.
Gouge, M.J. & Fisher, P.W., "A cryogenic xenon droplet generator for use in a compact laser plasma x–ray source", Rev. Sci. Instrum., vol. 68, No. 5, May 1997, pp. 2158–2162.
Torres, D., Jin, F., Richardson, M. & DePriest, C., "Characterization of mass–limited ice droplet laser plasmas", OSA Trends in Optics and Photonics, vol. IV, Extreme Ultraviolet Lithography, 1996, pp. 75–79.
Malmquist, L., Rymell, L. & Hertz, H.M., "High–repetition–rate droplet target for laser–plasma EUV generation", OSA Trends in Optics and Photonics, vol. IV, Extreme Ultraviolet Lithography, 1996, pp. 72–74.
Jin, F., Richardson, M.C., Shimkaveg, G.M. and Torres, D., "Characterization of a Laser Plasma Water Droplet EUV Source", Proceedings of SPEI, vol. 2523, 1995, pp. 81–87.
Rymell, L. and Hertz, H.M., "Droplet Target for Low–debris Laser–plasma Soft X–ray Generation", Optics Communications, vol. 103, 1993, pp. 105–110.
Heinzel, J. and Hertz, C.H., "Ink–jet Printing", Advances in Electronics and Electron Physics, Ed. by P.W. Hawkes, vol. 65, 1985, pp. 91–141.
Tanimoto, M., "Cryogenic Experimental Device for Production of Solid Pellets", Proceedings of 7th Symposium on Fusion Technology, Grenoble, 1972.

*Primary Examiner*—David V. Bruce
*Assistant Examiner*—Courtney Thomas
(74) *Attorney, Agent, or Firm*—Harness, Dickey & Pierce, P.L.C.

(57) ABSTRACT

A target material delivery system in the form of a nozzle (50) for an EUV radiation source (10). The nozzle (50) includes a target material supply line (66) having an orifice (68) through which droplets (76) of a liquid target material (64) are emitted, where the droplets (76) have a predetermined size, speed and spacing therebetween. The droplets (76) are mixed with a carrier gas (74) in a mixing chamber (54) enclosing the target material chamber (60) and the mixture of the droplets (76) and the carrier gas (74) enter a drift tube (56) from the mixing chamber (54). The droplets (76) are emitted into an accelerator chamber (124) from the drift tube (56) where the speed of the droplets (76) is increased to control the spacing therebetween. A vapor extractor (90) can be mounted to the accelerator chamber (124) or the drift tube (56) to remove the carrier gas (74) and target material vapor, which would otherwise adversely affect the EUV radiation generation.

39 Claims, 3 Drawing Sheets

GASDYNAMICALLY-CONTROLLED DROPLETS AS THE TARGET IN A LASER-PLASMA EXTREME ULTRAVIOLET LIGHT SOURCE

BACKGROUND OF THE INVENTION

1. Field of the Invention

This invention relates generally to a laser-plasma, extreme ultraviolet (EUV) radiation source and, more particularly, to a laser-plasma EUV radiation source having a target material delivery system that employs a droplet generator in combination with one or more of a drift tube, accelerator chamber and vapor extractor to provide tightly-controlled target droplets.

2. Discussion of the Related Art

Microelectronic integrated circuits are typically patterned on a substrate by a photolithography process, well known to those skilled in the art, where the circuit elements are defined by a light beam propagating through a mask. As the state of the art of the photolithography process and integrated circuit architecture becomes more developed, the circuit elements become smaller and more closely spaced together. As the circuit elements become smaller, it is necessary to employ photolithography light sources that generate light beams having shorter wavelengths and higher frequencies. In other words, the resolution of the photolithography process increases as the wavelength of the light source decreases to allow smaller integrated circuit elements to be defined. The current state of the art for photolithography light sources generate light in the extreme ultraviolet (EUV) or soft x-ray wavelengths (131–14 nm).

U.S. Pat. No. 6,324,256, entitled "Liquid Sprays as a Target for a Laser-Plasma Extreme Ultraviolet Light Source," and assigned to the assignee of this application, discloses a laser-plasma, EUV radiation source for a photolithography system that employs a liquid, such as xenon, as the target material for generating the laser plasma. A xenon target material provides the desirable EUV wavelengths, and the resulting evaporated xenon gas is chemically inert and is easily pumped out by the source vacuum system. Other liquids and gases, such as argon and krypton, and combinations of liquids and gases, are also available for the laser target material to generate EUV radiation.

The EUV radiation source employs a source nozzle that generates a stream of target droplets. The droplet stream is created by forcing a liquid target material through an orifice (50–100 microns diameter), and perturbing the flow by voltage pulses from an excitation source, such as a piezoelectric transducer, attached to a nozzle delivery tube. Typically, the droplets are produced at a rate (10–100 kHz) defined by the Rayleigh instability break-up frequency of a continuous flow stream for the particular orifice diameter.

To meet the EUV power and dose control requirements for next generation commercial semiconductors manufactured using EUV photolithography, the laser beam source must be pulsed at a high rate, typically 5–10 kHz. It therefore becomes necessary to supply high-density droplet targets having a quick recovery of the droplet stream between laser pulses, such that all laser pulses interact with target droplets under optimum conditions. This requires a droplet generator which produces droplets with precisely controlled size, speed and trajectory.

Various techniques have been investigated in the art for delivering liquid or solid xenon to the target location at the desirable delivery rate and having the desirable recovery time. These techniques include condensing supersonic jets, liquid sprays, continuous liquid streams and liquid/frozen droplets. As an example of this last technique, commercial droplet generators, such as inkjet printer heads, have been investigated for generating liquid droplets of different sizes that can be used in EUV sources.

The use of known droplet generators for providing a low temperature, high-volatility, low surface tension, low-viscosity fluid, such as liquid xenon, in combination with the need to inject the droplets into a vacuum provides significant design concerns. For example, because the target material is a gas at room temperature and pressure, the material must be cooled to form the liquid. Thus, it is important to prevent the liquid droplets from immediately flash boiling and disintegrating as they are emitted from the nozzle into the source vacuum. Also, because the cooled liquid droplets that do not immediately flash boil will evaporate and freeze as they travel through the source environment, the source parameters must be tightly controlled to insure the resulting size and consistency of the droplets at the target location is correct. Additionally, the speed, spacing and frequency of production of the droplets must be controlled.

SUMMARY OF THE INVENTION

In accordance with the teachings of the present invention, a target material delivery system, or nozzle, for an EUV radiation source is disclosed. The nozzle includes a target material chamber having an orifice through which droplets of a liquid target material are emitted. The size of the orifice and the droplet generation frequency is provided so that the droplets have a predetermined size, speed and spacing therebetween. In one embodiment, the droplets emitted from the target chamber are mixed with a carrier gas and the mixture of the droplets and carrier gas is directed into a drift tube. The carrier gas provides a pressure in the drift tube above the pressure of the source vacuum chamber to prevent the droplets from flash boiling and disintegrating. The drift tube allows the droplets to evaporate and freeze as they travel to become the desired size and consistency for EUV generation.

In one embodiment, the droplets are directed through an accelerator chamber from the drift tube where the speed of the droplets is increased to control the spacing therebetween. A vapor extractor can be provided relative to an exit end of the drift tube or accelerator chamber that separates the carrier gas and the vapor resulting from droplet evaporation so that these by-products are not significantly present at the laser focus area, and therefore do not absorb the EUV radiation that is generated.

Additional objects, advantages and features of the present invention will become apparent from the following description and appended claims, taken in conjunction with the accompanying drawings.

DISCUSSION OF THE EMBODIMENTS

The following discussion of the embodiments of the invention directed to controlling the target droplets in a laser-plasma, extreme ultraviolet radiation source is merely exemplary in nature, and is in no way intended to limit the invention, or it's applications or uses.

Figure 1:
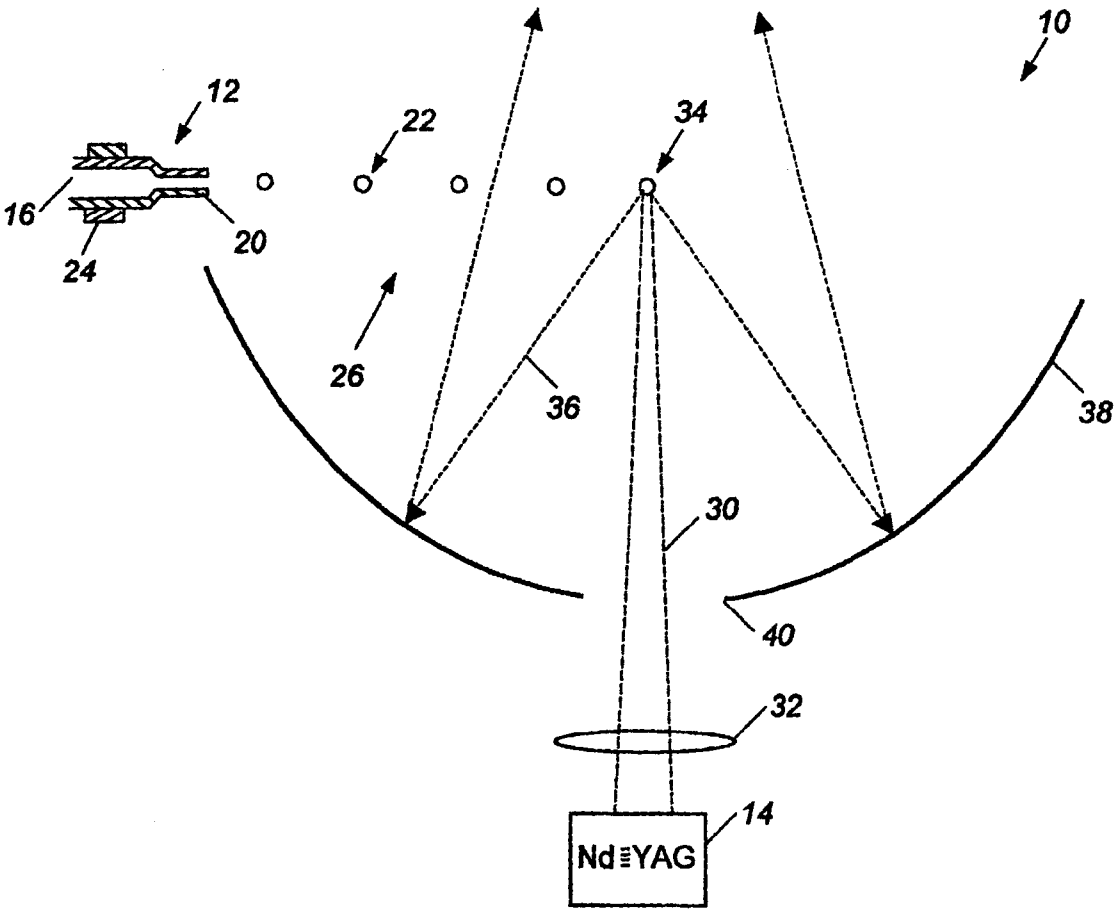
FIG. 1 is a plan view of a laser-plasma, extreme ultraviolet radiation source.

FIG. 1 is a plan view of an EUV radiation source 10 including a nozzle 12 and a laser beam source 14. A liquid 16, such as liquid xenon, flows through the nozzle 12 from a suitable source (not shown). The liquid 16 is forced under pressure through an exit orifice 20 of the nozzle 12 where it is formed into a stream 26 of liquid droplets 22 directed to a target location 34. A piezoelectric transducer 24 positioned on the nozzle 12 perturbs the flow of liquid 16 to generate the droplets 22. The droplets 22 are emitted from the nozzle as liquid droplets, but as the droplets 22 travel from the nozzle 12 to the target location 34 in the vacuum environment, they partially evaporate and freeze.

A laser beam 30 from the source 14 is focused by focusing optics 32 onto the droplet 22 at the target location 34, where the source 14 is pulsed relative to the rate of the droplets 22 as they reach the target location 34. The energy of the laser beam 30 vaporizes the droplet 22 and generates a plasma that radiates EUV radiation 36. The EUV radiation 36 is collected by collector optics 38 and is directed to the circuit (not shown) being patterned. The collector optics 38 can have any suitable shape for the purposes of collecting and directing the radiation 36. In this design, the laser beam 30 propagates through an opening 40 in the collector optics 38, however, other orientations are known. The plasma generation process is performed in a vacuum.

Figure 2:
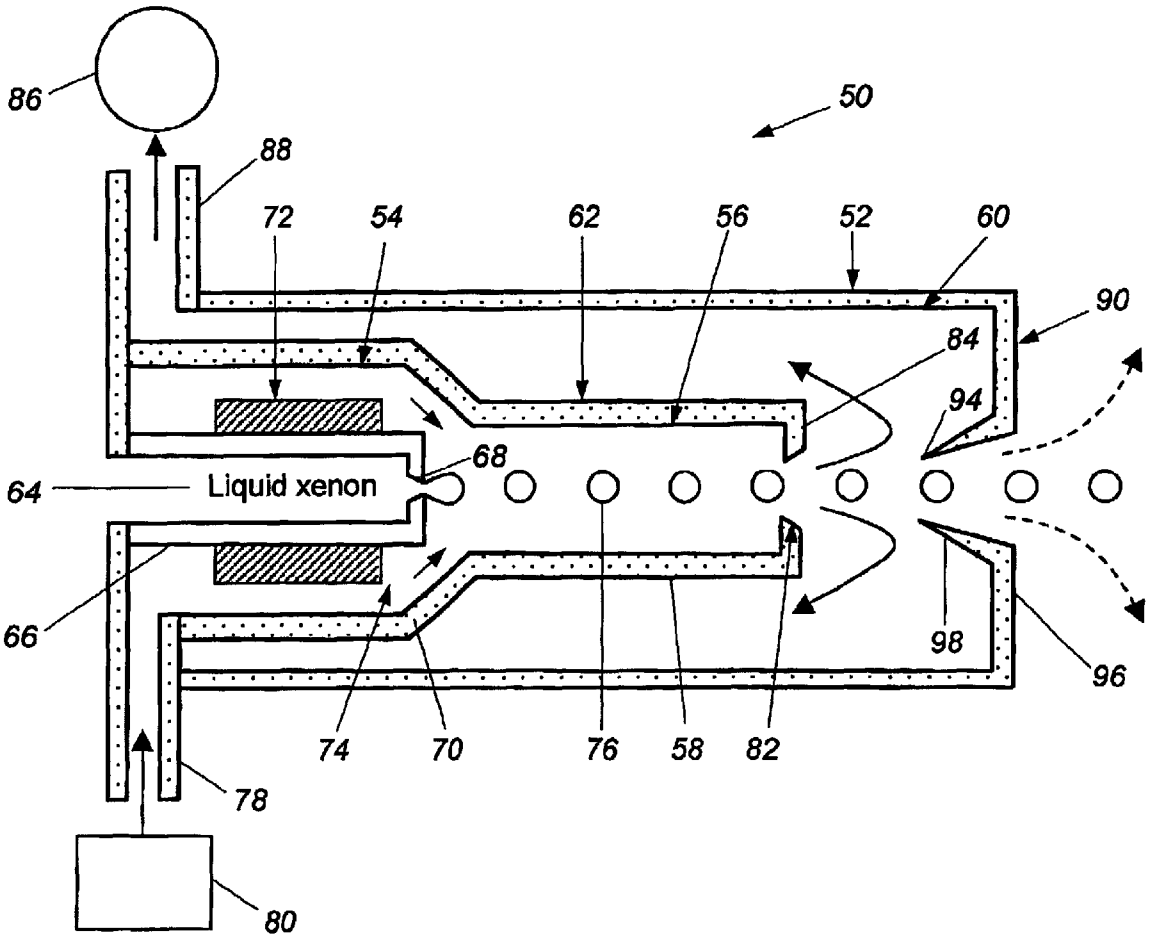
FIG. 2 is a cross-sectional view of a target material delivery system herein referred to as a nozzle for a laser-plasma, extreme ultraviolet radiation source including a drift tube and a vapor extractor, according to the invention.

FIG. 2 is a cross-sectional view of a target material delivery system in the form of a nozzle 50, according to the invention, applicable to be used as the nozzle 12 in the source 10. The nozzle 50 includes an outer cylindrical housing 52 defining an outer vapor extraction chamber 60 and an inner cylindrical housing 62 coaxial with the housing 52, as shown. The housing 62 includes an outer wall 58 defining a mixing chamber 54 and a drift tube 56 connected thereto. A cylindrical target material supply line 66 is positioned within and coaxial to the mixing chamber 54 through which the target material 64, here liquid xenon, is transferred under pressure from a suitable source (not shown). The supply line 66 includes an orifice 68 proximate a tapered shoulder region 70 in the wall 58 connecting the mixing chamber 54 to the drift tube 56, as shown.

A piezoelectric transducer 72 is provided external to and in contact with the supply line 66, and agitates the chamber 66 so that target droplets 76 are emitted from the orifice 68 into the drift tube 56. The size of the orifice 68 and the frequency of the piezoelectric agitation are selected to generate the target droplets 76 of a predetermined size. Typically, the piezoelectric transducer 72 is pulsed at a frequency that is related to the Rayleigh break-up frequency of the liquid xenon for a particular diameter of the orifice 68 to provide a continuous flow stream, so that the droplets 76 have the desired size at the target location 34.

A gas delivery pipe 78 is connected to the mixing chamber 54 and directs a carrier gas, such as helium or argon, from a carrier gas source 80 to the mixing chamber 54. Other carrier gases can also be used as would be appreciated by those skilled in the art. The carrier gas is relatively transparent to the laser beam 30 and may be cooled so as to aid in the freezing of the droplets 76. The carrier gas source 80 includes one or more canisters (not shown) holding the carrier gases or, alternatively, a pump from a closed-loop gas recirculation system. The source 80 may include a valve (not shown) that selectively controls which gas, or what mixture of the gases, is admitted to the mixing chamber 54 for mixing with the droplets 76 and a heat exchanger for temperature control. The carrier gas provides a pressure in the drift tube 56 above the pressure of the vacuum chamber in which the nozzle 50 is positioned. The pressure, volume and flow rate of the carrier gas would application specific to provide the desired pressure.

Because the pressure in the drift tube 56 and the temperature of the material 64 are low, the droplets 76 begin to evaporate and freeze, which creates a vapor pressure. The combination of the vapor pressure and the carrier gas pressure prevents the droplets 76 from flash boiling, and thus disintegrating. In certain applications, the carrier gas may not be needed because the vapor pressure alone may be enough to prevent the droplets 76 from flash boiling.

The carrier gas and target material mixture flows through the drift tube 56 for a long enough period of time to allow the droplets 76 to evaporatively cool and freeze to the desired size and consistency for the EUV source application. The length of the drift tube 56 is optimized for different target materials and applications. For xenon, drift tube lengths of 10–20 cm appear to be desirable. The droplets 76 are emitted from the drift tube 56 through an opening 82 in an end plate 84 of the drift tube 56 into the chamber 60, and have a desirable speed, spacing and size.

The carrier gas and evaporation material are generally unwanted by-products in the target location 34 because they may absorb the EUV radiation decreasing the EUV production efficiency. To remove these materials from the droplet stream, a vapor extractor 90 is provided, according to the invention. The vapor extractor 90 is mounted, in any desirable manner, to the housing 52 opposite the chamber 60, as shown. The extractor 90 includes an end plate 96 including a conical portion 98 defining an opening 94. The conical portion 98 may, alternatively, be replaced by a nozzle or orifice of some other shape to create the opening 94. The opening 94 is aligned with the droplets 76 so that the droplets 76 exit the nozzle 50 through the opening 94. The vapor extractor 90 prevents the majority of the evaporation material and carrier gas mixture from continuing along with the droplet stream because it is collected in the vapor extraction chamber 60. A pump 86 pumps the extracted carrier gas and the evaporation material out of the chamber 60 through a pipe 88.

Figure 3:
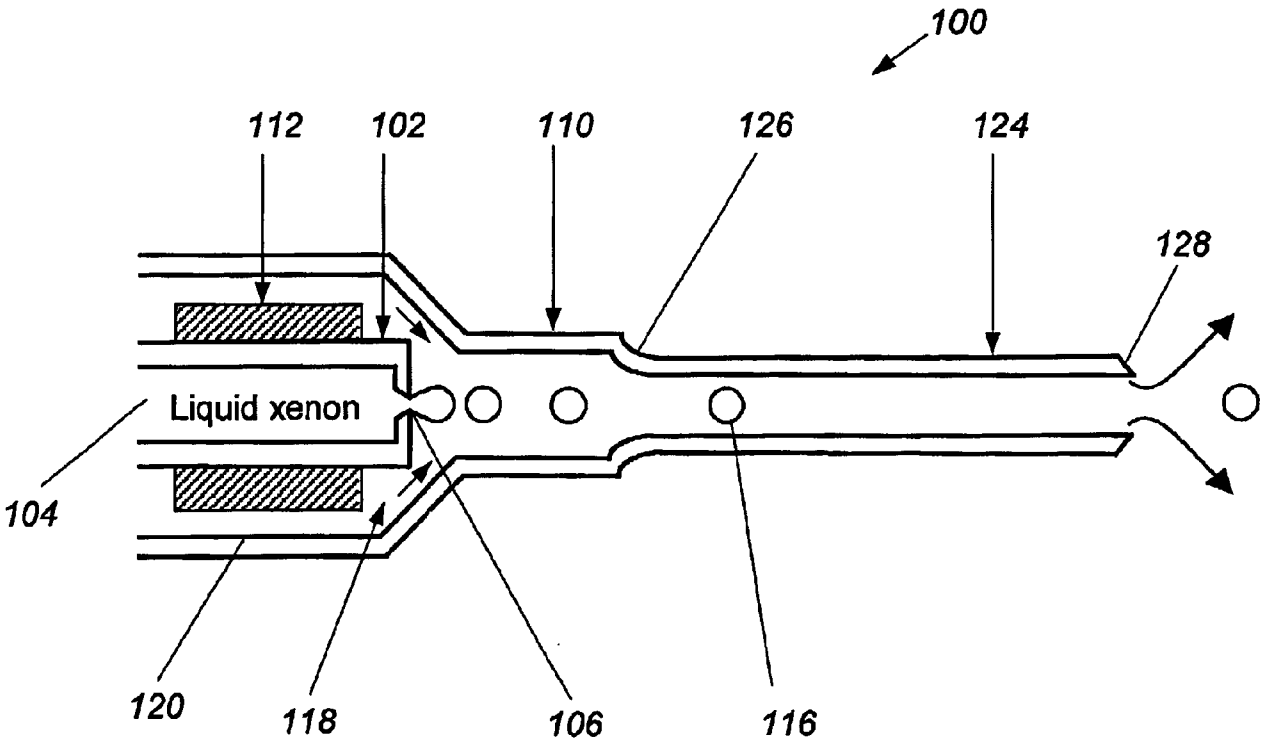
FIG. 3 is a cross-sectional view of a nozzle for a laser-plasma, extreme ultraviolet radiation source including a drift tube and an accelerator chamber, according to the invention.

FIG. 3 is a cross-sectional view of a nozzle 100 also applicable to be used as the nozzle 12 in the source 10, according to another embodiment of the present invention. The nozzle 100 includes a target material chamber 102 directing a liquid target material 104 through an orifice 106 into a drift tube 110. As above, the nozzle 100 includes a piezoelectric vibrator 112 that agitates the target material to generate target droplets 116 of a predetermined diameter exiting the orifice 106. The droplets 116 are mixed with a carrier gas 118 from a carrier gas chamber 120 as the droplets 116 enter the drift tube 110. The droplets and carrier gas mixture propagate through the drift tube 110 where the droplets 116 partially evaporate and freeze. The carrier gas provides a pressure that prevents the droplets 116 from immediately flash boiling before they have had an opportunity to freeze. The drift tube 110 allows the droplets 116 to partially or wholly freeze so that they will not breakup during acceleration through the nozzle 100.

In certain designs, the spacing between the droplets 116 may not be correct as they exit the orifice 106 as set by the continuous break-up frequency. To increase the spacing between the droplets 116, the droplet and carrier gas mixture enters an accelerator section 124 connected to the drift tube 110. A narrowed shoulder region 126 between the drift tube 110 and the accelerator section 124 causes the target material and gas mixture to accelerate through the accelerator section 124. The increase in speed causes the distance between the droplets 116 in the mixture to increase. The length of the accelerator section 124 is also application specific, and is selected for a particular target material speed and size. The diameter of the accelerator section 124 is determined based on the diameter of the droplets 116 so that the section 124 is just wide enough to allow the droplets 116 to pass and be accelerated by the carrier gas pressure.

The droplets 116 exit the accelerator section 124 through an exit orifice 128. The droplets 116 are directed to the target location 34, where they are vaporized by the laser beam 30 to generate the plasma, as discussed above.

The nozzle 100 does not employ a vapor extractor in this embodiment, but such an extractor could be optionally added. In certain designs and applications, the carrier gas and evaporation material can be removed by the source chamber pump. Also, in some applications, the evaporation material and carrier gas may not significantly adversely affect the EUV radiation generation process.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. A target material delivery system, in the form of a nozzle, for an extreme ultraviolet radiation source comprising:

a target material supply line including an orifice, said target material chamber line configured to emit a stream of droplets of a target material from the orifice;

a mixing chamber enclosing the target chamber, said mixing chamber configured to receive the stream of droplets and a carrier gas;

a drift chamber coupled to the mixing chamber and configured to receive the droplet and carrier gas mixture, said drift chamber configured to prevent the droplets from flash boiling and to allow the droplets to freeze;

an accelerator chamber coupled to the drift chamber and configured to receive the droplet and carrier gas mixture, said accelerator chamber including an exit opening opposite the drift chamber through which the droplet stream exits the nozzle, said accelerator chamber configured to cause the speed of the droplets to increase; and an extractor mounted to the accelerator chamber proximate the exit opening, said extractor configured to remove a substantial portion of the carrier gas and target material vapor from the droplet and carrier gas mixture.

2. The system according to claim 1 wherein the target material supply line, the mixing chamber, the drift chamber and the accelerator chamber are cylindrical.

3. The system according to claim 2 wherein the drift chamber has a smaller diameter than the mixing chamber and the accelerator chamber has a smaller diameter than the drift chamber.

4. The system according to claim 1 further comprising a carrier gas source, said carrier gas source being in fluid communication with the mixing chamber through a valve.

5. The system according to claim 1 wherein the extractor is coupled to a vapor extractor chamber enclosing the drift chamber, wherein the carrier gas and the target material vapor extracted by the extractor from the mixture is collected in the vapor extractor chamber.

6. The system according to claim 5 further comprising a vapor pump, said vapor pump being coupled to the vapor extractor chamber and configured to remove the extracted carrier gas and target material vapor therein.

7. The system according to claim 1 wherein the extractor includes a conical section aligned with the stream of droplets and the exit opening.

8. The system according to claim 1 further comprising a piezoelectric transducer in contact with the target material supply line, said piezoelectric transducer configured to agitate the target material supply line to generate the stream of droplets.

9. The system according to claim 1 wherein the target material is liquid xenon.

10. A nozzle for an extreme ultraviolet radiation source comprising:

a target material chamber including an orifice, said target material chamber configured to emit a stream of droplets of a target material from the orifice; and a drift chamber aligned with the orifice and configured to receive the stream of droplets, said drift chamber being of a predetermined length so as to allow the droplets to freeze as they propagate through the drift chamber, said drift chamber including a drift chamber opening opposite the target material chamber through which the droplets exit the drift chamber.

11. The nozzle according to claim 10 wherein the drift chamber includes a carrier gas opening configured to receive a carrier gas, said carrier gas mixing with the stream of droplets in the drift chamber, said carrier gas, in combination with vapor from the droplets, providing a pressure within the drift chamber so as to prevent the droplets from flash boiling.

12. The nozzle according to claim 11 wherein the carrier gas is introduced into the drift chamber through a mixing chamber that encloses the target material chamber in a coaxial manner, said drift chamber being in fluid communication with the mixing chamber.

13. The nozzle according to claim 12 wherein the target material chamber, the mixing chamber and the drift chamber are cylindrical.

14. The nozzle according to claim 10 further comprising a vapor extractor including a vapor extractor opening aligned with the target material chamber orifice and the drift chamber opening, said vapor extractor configured to extract vapor from the stream of droplets resulting from partial evaporation of the droplets.

15. The nozzle according to claim 14 wherein the vapor extractor includes a conical portion aligned with the drift chamber opening.

16. The nozzle according to claim 14 further comprising a vapor extractor chamber, said vapor extractor chamber configured to collect vapor extracted by the vapor extractor, said vapor extractor chamber enclosing the drift chamber.

17. The nozzle according to claim 16 further comprising a vapor pump, said vapor pump being coupled to the vapor extractor chamber and configured to remove the extracted vapor collected therein.

18. The nozzle according to claim 10 further comprising an accelerator chamber coupled to the drift chamber and configured to receive the stream of droplets therefrom, said accelerator chamber including an accelerator chamber exit opening opposite the drift chamber through which the droplet stream exits the nozzle, said accelerator chamber configured to cause the speed of the droplets to increase.

19. The nozzle according to claim 18 wherein the drift tube and the accelerator chamber are cylindrical, where the accelerator chamber has a smaller diameter than the drift chamber.

20. The nozzle according to claim 10 wherein the target material is liquid xenon.

21. The nozzle according to claim 10 further comprising a piezoelectric transducer in contact with the target material chamber, said piezoelectric transducer configured to agitate the material chamber to generate the stream of droplets.

22. A nozzle for an extreme ultraviolet radiation source comprising:

a target material supply line including an orifice, said target material supply line configured to emit a stream of droplets of a target material from the orifice;

a drift chamber configured to receive the stream of droplets from the target material supply line, said stream of droplets propagating through the drift chamber as the droplets freeze, said stream of droplets exiting the drift chamber through an exit opening; and a vapor extractor positioned relative to the exit opening in the drift chamber, said vapor extractor configured to remove vapor from the condensation of the droplets.

23. The nozzle according to claim 22 wherein the drift chamber includes a carrier gas opening configured to receive a carrier gas, said carrier gas mixing with the stream of droplets in the drift chamber, said carrier gas, in combination with vapor from the droplets, providing a pressure within the drift chamber so as to prevent the droplets from flash boiling.

24. The nozzle according to claim 23 wherein the carrier gas is introduced into the drift chamber through a mixing chamber surrounding the target material supply line in a coaxial manner, said drift chamber being in fluid communication with the mixing chamber.

25. The nozzle according to claim 22 wherein the vapor extractor includes a conical portion aligned with the exit opening.

26. The nozzle according to claim 22 further comprising a vapor extractor chamber, said vapor extractor chamber configured to collect vapor extracted by the vapor extractor, said vapor extractor chamber enclosing the drift chamber.

27. The nozzle according to claim 26 further comprising a vapor pump, said vapor pump being coupled to the vapor extractor chamber and configured to remove the extracted vapor collected therein.

28. The nozzle according to claim 22 wherein the target material is liquid xenon.

29. The nozzle according to claim 22 further comprising a piezoelectric transducer in contact with the target material supply line, said piezoelectric transducer configured to agitate the target material supply line to generate the stream of droplets.

30. A nozzle for an extreme ultraviolet radiation source comprising:

a target material supply line including an orifice, said target material supply line configured to emit a stream of droplets of a target material from the orifice;

a drift chamber configured to receive the stream of droplets from the target material supply line, said stream of droplets propagating through the drift chamber as the droplets freeze, said stream of droplets exiting the drift chamber through a drift chamber exit opening; and an accelerator chamber coupled to the drift chamber and configured to receive the stream of droplets therefrom, said accelerator chamber including an accelerator chamber exit opening opposite the drift chamber through which the droplet stream exits the nozzle, said accelerator chamber configured to cause the speed of the droplets to increase.

31. The nozzle according to claim 30 wherein the target material supply line, the drift chamber and the accelerator chamber are cylindrical.

32. The nozzle according to claim 30 wherein the drift chamber includes a carrier gas opening configured to receive a carrier gas, said carrier gas mixing with the stream of droplets in the drift chamber, said carrier gas, in combination with vapor from the droplets, providing a pressure within the drift chamber so as to prevent the droplets from flash boiling.

33. The nozzle according to claim 32 wherein the carrier gas is introduced into the drift chamber through a mixing chamber that encloses the target material supply line in a coaxial manner, said drift tube being in fluid communication with the mixing chamber.

34. The nozzle according to claim 30 further comprising a vapor extractor including a vapor extractor opening aligned with the target material chamber orifice and the drift chamber opening, said vapor extractor configured to extract vapor from the stream of droplets resulting from evaporation of the droplets.

35. The nozzle according to claim 34 wherein the vapor extractor includes a conical portion aligned with the drift chamber opening.

36. The nozzle according to claim 34 further comprising a vapor extractor chamber, said vapor extractor chamber configured to collect vapor extracted by the vapor extractor, said vapor extractor chamber enclosing the drift chamber.

37. The nozzle according to claim 36 further comprising a vapor pump, said vapor pump being coupled to the vapor extractor chamber and configured to remove the extracted vapor collected therein.

38. The nozzle according to claim 30 wherein the target material is liquid xenon.

39. The nozzle according to claim 30 further comprising a piezoelectric transducer in contact with the target material supply line, said piezoelectric transducer configured to agitate the target material supply line to generate the stream of droplets.

* * * * *